US009242260B2

(12) United States Patent
Stevenson et al.

(10) Patent No.: US 9,242,260 B2
(45) Date of Patent: Jan. 26, 2016

(54) DIRECTED MULTIPORT EDUCTOR AND METHOD OF USE

(75) Inventors: Gary L. Stevenson, Spanishburg, WV (US); Daniel R. Whitcher, Sugar Land, TX (US)

(73) Assignee: PROVEN TECHNOLOGIES, LLC, Houston, TX (US)

( * ) Notice: Subject to any disclaimer, the term of this patent is extended or adjusted under 35 U.S.C. 154(b) by 637 days.

(21) Appl. No.: 12/752,957

(22) Filed: Apr. 1, 2010

(65) Prior Publication Data

US 2011/0240753 A1 Oct. 6, 2011

(51) Int. Cl.

| | |
|---|---|
| ***B05B 7/30*** | (2006.01) |
| ***B01F 3/12*** | (2006.01) |
| ***B01F 5/20*** | (2006.01) |
| *B01F 5/04* | (2006.01) |

(52) U.S. Cl.

CPC ..... *B05B 7/30* (2013.01); *B01F 3/1228* (2013.01); *B01F 5/043* (2013.01); *B01F 5/20* (2013.01); *B01F 2003/1257* (2013.01); *B01F 2005/0438* (2013.01)

(58) Field of Classification Search

CPC . A01C 23/042; A01M 7/0092; B05B 7/2443; B05B 7/2462; B05B 7/30; B05B 7/0433; B05B 7/2424; B01F 5/0413; A61B 1/00068; A61B 1/125; A63B 53/10

USPC ..... 239/10, 434, 431, 429, 426, 427, 79

See application file for complete search history.

(56) References Cited

U.S. PATENT DOCUMENTS

| | | | | |
|---|---|---|---|---|
| 3,304,564 | A * | 2/1967 | Green et al. | 15/1.7 |
| 3,470,826 | A | 10/1969 | Foulds | |
| 3,610,535 | A * | 10/1971 | Bradshaw | 239/305 |
| 3,678,140 | A | 7/1972 | Adams et al. | |
| 4,673,335 | A * | 6/1987 | Nicodemus | 417/54 |
| 4,781,467 | A | 11/1988 | Williams | |
| 5,322,222 | A | 6/1994 | Lott | |
| 5,323,967 | A * | 6/1994 | Tanaka et al. | 239/417.3 |
| 5,447,394 | A * | 9/1995 | Shepard | 406/48 |
| 5,664,733 | A | 9/1997 | Lott | |

(Continued)

FOREIGN PATENT DOCUMENTS

| | | |
|---|---|---|
| WO | WO 2005/081709 A2 | 9/2005 |
| WO | PCT/US2011/030937 | 6/2011 |
| WO | PCT/US2011/030937 | 10/2012 |

OTHER PUBLICATIONS

LOBESTAR Mixing Eductor brochure by Vortex Ventures.

Stratton, Harry, Liquid Jet Eductors—The "Pumps" with No Moving Parts, originally published in Plant Engineering in Apr. 26, 1976 by the Technical Publishing Company.

(Continued)

*Primary Examiner* — Arthur O Hall
*Assistant Examiner* — Chee-Chong Lee
(74) *Attorney, Agent, or Firm* — David B. Dickinson

(57) ABSTRACT

A directed multiport jetting nozzle in an eductor having a focal point of the motive fluid inside the throat of a venturi-diffuser body of the present eductor provides an efficient pump and mixer providing substantial surface contact area between the motive flow and the bulk material for movement through the outlet of the eductor. The result of this design provides a homogeneous mixture of the motive fluid and the bulk material which may be hydrating or wetting, or the creation of a slurry.

9 Claims, 5 Drawing Sheets

(56) References Cited

U.S. PATENT DOCUMENTS

| | | | | |
|---|---|---|---|---|
| 6,000,839 | A * | 12/1999 | Lott | 366/181.5 |
| 6,427,724 | B2 * | 8/2002 | Hua | 137/888 |
| 7,048,432 | B2 * | 5/2006 | Phillippi et al. | 366/164.1 |
| 7,311,270 | B2 | 12/2007 | Kapila | |
| 7,635,218 | B1 | 12/2009 | Lott | |

OTHER PUBLICATIONS

European Patent Office Search Report dated Nov. 3, 2014 related to application No. 11763509.4-1760/2555860; national stage from PCT/US2011/030937.

* cited by examiner

DIRECTED MULTIPORT EDUCTOR AND METHOD OF USE

BACKGROUND OF INVENTION

The present invention relates to a fluid jetting device; specifically, to a multiport nozzle directing a motive flow into the throat of a venturi-diffuser thus permitting homogeneous mixing, shearing or wetting of a bulk fluidal material with the motive flow to an outlet of the diffuser.

Eductor arrangements have long been used to provide pumping, mixing, blending, hydrating and shearing in a wide variety of industries, including chemical, petrochemical, pulp and paper, food, water and waste water treatment facilities. These types of eductors can be used for lifting, pumping, mixing or agitating liquids or other flowable materials such as powders or slurries. Eductors use a venturi design which permits small eductors to move large volumes of fluids or fluidal materials. Because the motive flow provides the kinetic energy necessary to entrain and move another fluid after thoroughly mixing the two, the mixture and discharge of the combined material is accomplished with lowered motive energy usage than if the volume was pumped with a conventional centrifugal pump.

The low pressure section or mixing chamber of the eductor pulls the flowable bulk material into the venturi neck of the eductor and out the diffuser or belled end of the eductor. Most prior art eductor bodies provided a single nozzle extending into the neck of the venturi, thereby hindering mixing in the vacuum or mixing chamber of the eductor body. The present invention separates the multiple directed nozzle ports from the venturi neck, thereby opening the mixing chamber to the rapid and unimpeded bulk material flow which is thereafter carried into the neck of the venturi. Eductor systems have long been recognized as providing lower capital costs because they have a simple design and limited size, require less energy to drive the pump providing motive force, provide less heating of the transported material, provide less settling because of the volume of circulation or movement provided, and provide better control when the bulk material and inlet side are properly sealed to outside air. These advantages are improved with this new directed multiport nozzle design when combined with the characteristics of the venturi-diffuser of the present invention.

SUMMARY OF INVENTION

The eductor of this application comprises a cylindrical body having a longitudinal bore therethrough; a perpendicular extension having a bore therethrough intersecting the cylindrical body permitting a flow of bulk materials into a hollow, low-pressure vestibular mixing chamber portion of the eductor; said low-pressure vestibular mixing chamber portion of the eductor formed between a face of a multiport jetting nozzle inserted in a first end of the cylindrical body, the intersection of the perpendicular extension, and an inlet lip of a venturi-diffuser inserted in a second end of the cylindrical body; and, said multiport jetting nozzle providing a plurality of ports directing a fluid flow from a first inlet of the cylindrical body toward an inlet lip of the venturi-diffuser having a venturi throat narrowing to provide turbulent flow, enlarging at an outlet of the diffuser wherein the fluid flow traversing the hollow vestibular mixing chamber from the multiport jetting nozzle carries the bulk material from the perpendicular extension converging in an interior portion of the venturi-diffuser throat.

This eductor's multiport jetting nozzle provides three or more directed ports converging on an interior portion of the inlet to the venturi-diffuser and can provide at least five directed ports converging on an interior portion of the inlet to the venturi-diffuser. The eductor's multiport jetting nozzle provides an angled ejection of the fluid converging on a point within the venturi-diffuser.

A method of fluid mixing bulk materials can be accomplished by supplying a fluidal bulk material to a perpendicular inlet of an eductor; and, supplying a fluid motive flow through an inlet of the eductor to a multiported jetting nozzle directing the motive fluid flow across a hollow vestibular section of the eductor and into a centralized portion of a throat of a venturi-diffuser for movement down the venturi-diffuser to homogeneously mix the fluidal bulk material with the motive fluid flow.

This structure can also accommodate a method of fluidic mixing of a variety of fluidal bulk materials with varying physical characteristics by supplying a first fluidal bulk material to an a first inlet of an eductor; supplying a fluid motive flow through a second inlet of the eductor to a multiported nozzle directing the fluid flow across a vestibular section of the eductor and into a centralized portion of a throat of a venturi-diffuser for movement down the venturi-diffuser to homogeneously mix the fluidic fluidal bulk material with the fluid flow until the first fluidal bulk material has been completely mixed; adding a second fluidal bulk material to a third inlet on the first inlet of an eductor; and, varying a rate of passage of the fluidal bulk material to the vestibular section of the eductor for mixing. This process can also provide the additional step of varying the fluid motive flow to the multiported jetting nozzle to correspond to the physical characteristics of the second fluidal bulk material.

Another method of fluid mixing of a variety of fluidal bulk materials with varying physical characteristics can be accomplished by supplying a first fluidal bulk material to a perpendicular inlet of an eductor; supplying a motive fluid flow through an inlet of the eductor to a multiported nozzle directing the motive fluid flow across a hollow vestibular section of the eductor and converging in a centralized portion of a throat of a venturi-diffuser for movement down the venturi-diffuser to homogeneously mix the fluidal bulk material with the fluid flow until the fluidal bulk material has been completely mixed; adding a second fluidal bulk material to a secondary inlet on the perpendicular inlet of an eductor; and, varying a rate of passage of the fluidal bulk material to the hollow vestibular section of the eductor for mixing.

This method can further comprise the additional step of varying the motive fluid flow to the multiported jetting nozzle to correspond to the physical characteristics of the second fluidal bulk material.

DETAILED DESCRIPTION OF EMBODIMENTS OF THE INVENTION

Figure 1:
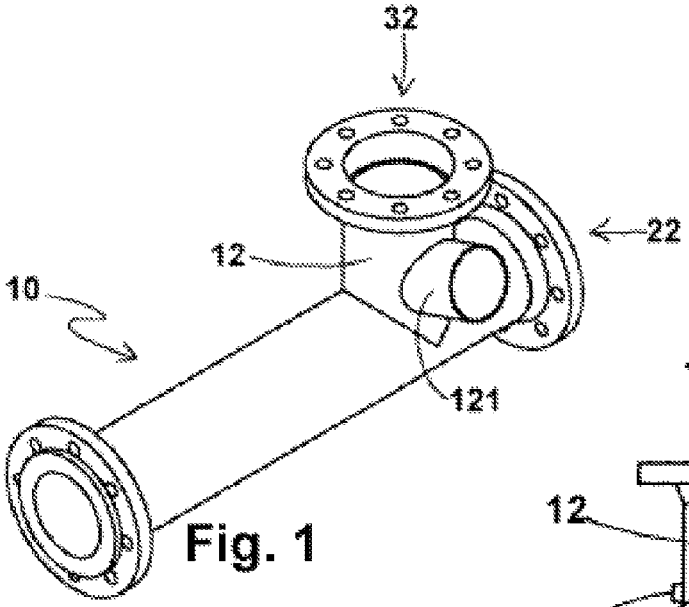
FIG. 1 is a perspective three-dimensional drawing of the eductor body embodiment of the present invention.
Figure 3:
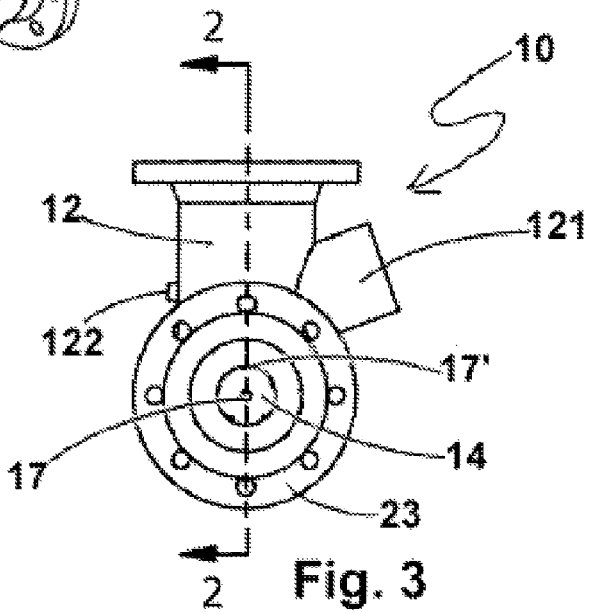
FIG. 3 is an end view of the multiport directed jetting nozzle of the present application of the cross-sectional body of FIG. 2.
Figure 2:
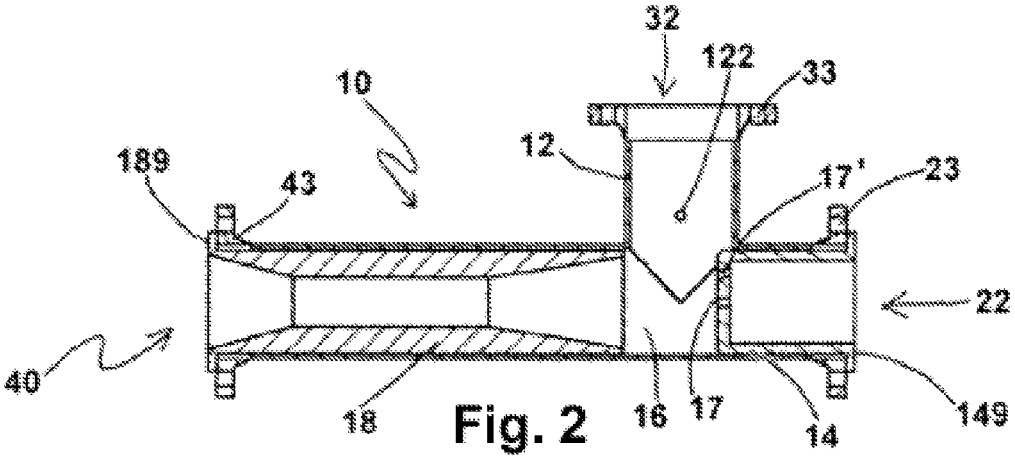
FIG. 2 is a side cross-sectional view of the eductor of the present application showing the spaced relationship between the nozzle body inserted into the eductor and the venturi-diffuser body inserted into the opposing end of the eductor body.

The present invention relates to a directed multiport jetting eductor device 10, as more specifically shown in FIGS. 1 and 2, for mixing, blending, hydrating or shearing a fluidal or flowable material such as a powder or slurry in a high velocity motive flow 22 which imparts extreme shearing forces on any material being drawn from a source 32 through a perpendicular extension 12 to the eductor 10 into a vestibular portion 16 of the device 10 thereby eliminating fisheyes, microgels and clumps normally found in many mixing devices. FIG. 1 is a perspective three dimensional view and FIG. 2 is a cross-sectional side view of the eductor body 10 showing the spaced relationship between the multiport directed nozzle 14 inserted in the inlet of the body for directing flow 22 and the venturi-diffuser body insert 18 inserted in the opposing end of the eductor body 10. The slurry output from this mixing/shearing process is then carried through a venturi-diffuser body 18 to the outlet 40 completing the process. The eductor body 10 of the present embodiment is fabricated from 304 stainless steel and provides a flange 23, 33, and 43 on each end of the eductor body 10. Other compatible materials could be used to fabricate the eductor body 10 without departing from the invention disclosed herein. Stainless steel was chosen as an economical corrosion resistant material, but other alloys or other materials including plastics or ceramics, capable of use for more corrosive, higher temperatures, or more severe operational environments could readily be substituted. Other types of materials might be substituted based upon the type of service required; for example, where the reactivity of the motive fluid and the bulk flowable materials expected to be mixed, wetted or blended is a concern. The extension neck 12 can not only connect to the source of the bulk material desired to be mixed or blended, but can also provide a port 121 for injecting other fluids into the eductor body 10 which is shown in FIGS. 1 and 3 as a port at an angle to the extension neck to permit the ready flow of a fluid into the low-pressure vestibular portion 16 as shown in FIG. 2 of the eductor body 10. A second, smaller port 122, seen in FIGS. 2 and 3, can also be provided to either provide a vacuum to move material into the mixing chamber or to inject other materials, such as chemicals into the mixing chambers as desired by the operator.

Figure 4:
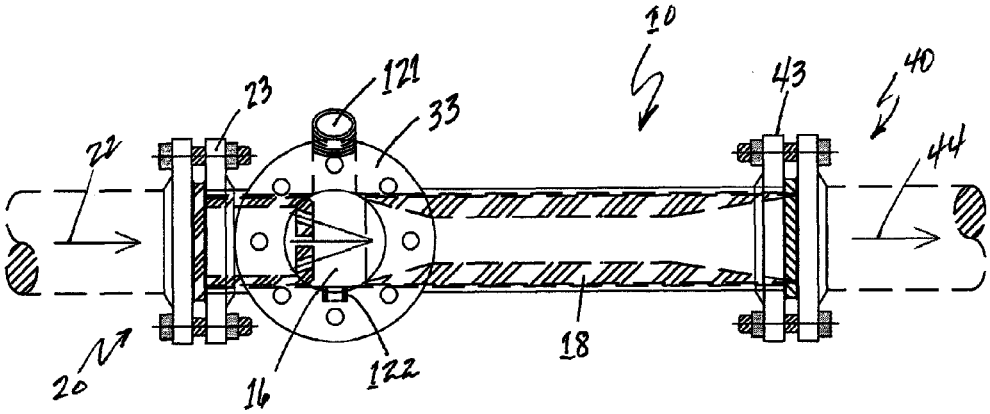
FIG. 4 is a top plan view of the eductor body assembly showing the relative spaced relationship of the multiport directed nozzle body and the venturi-diffuser of the present application
Figure 5:
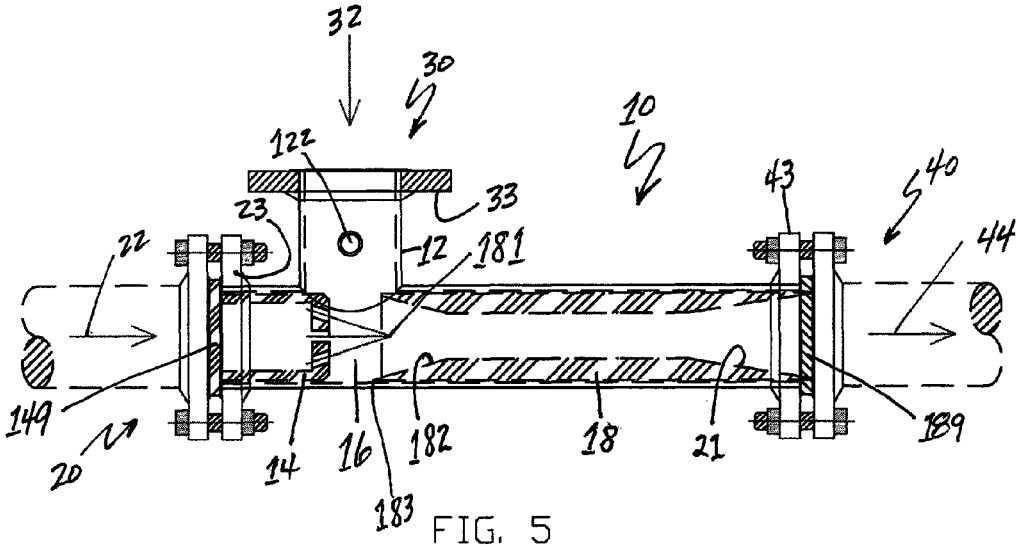
FIG. 5 is a side plan view of the eductor body assembly showing the relative spaced relationship of the multiport directed nozzle body and the venturi-diffuser of the present application.

Returning to FIG. 2, both the multiport nozzle 14 and the venturi-diffuser body 18 provide flanges 149 and 189 permitting each to be securely fastened between the body flanges 23 and 43 and the piping 20 from the pump for the motive flow and the outlet pipe (both of which are partially shown in FIGS. 4 and 5.) In FIG. 5 an eductor body flange 33 on extension 12 permits the sealed hermetic connection of a flowable bulk material source that can be drawn into the vestibular portion 16 of the eductor body 10 for mixing. The flanges on each opening of the eductor body 10 used in conjunction with the sealing flanges on the nozzle and diffuser bodies, which are crimped between the input and outlet lines of the body, permit the highly efficient mixing of motive force fluid with the bulk material without adjustment for outside air, therefore allowing proper measuring of flow rates and output to maximize the efficiency of the process. Since there is no leakage in the system, the volume of motive flow and the mass of the bulk flowable material being mixed, sheared or wetted, can be carefully controlled in a dynamic manner through either manual or electronic adjustment of pump speed or pressure and by opening and closing the valve (not shown) on the flowable bulk material delivery input extension. These control mechanisms can be automated with standard programmable logic devices (PLDs) or by standardized digitial technology now found in this art field.

Figure 6:
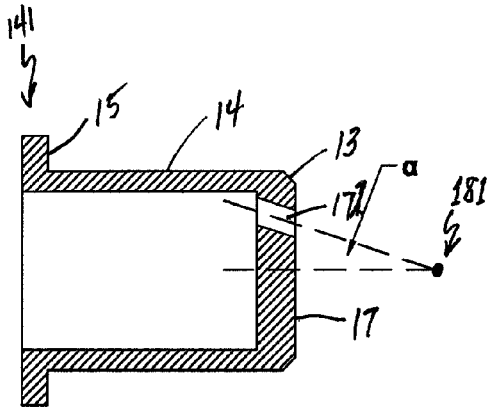
FIG. 6 is a cross-sectional view of a smaller nozzle embodiment of the present invention providing three outlet ports.
Figure 7:
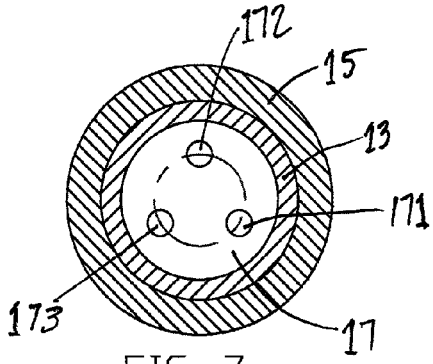
FIG. 7 is an outlet face view of the smaller nozzle embodiment of the nozzle of FIG. 6.
Figure 10:
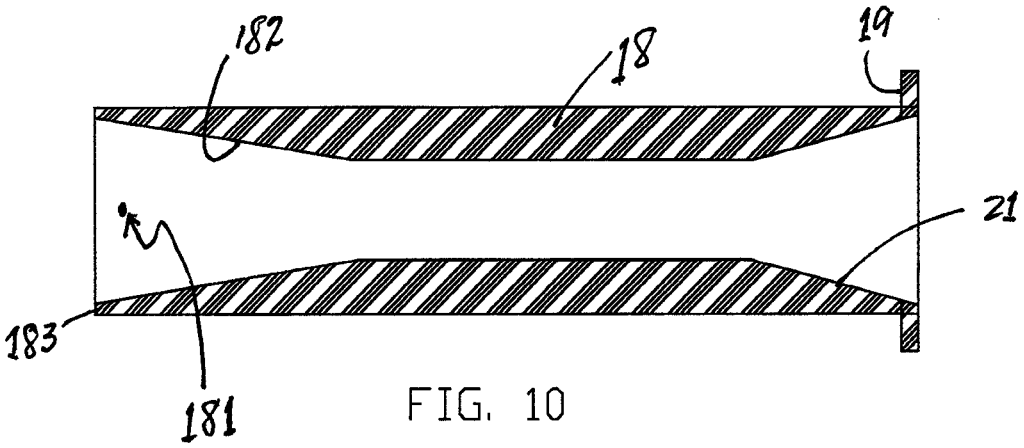
FIG. 10 is a cross-sectional side view of a smaller diameter embodiment of the venturi-diffuser.

The motive flow 22 is provided by a fluid pump (not shown, but well known to those having ordinary skill in this art) which may be water or air or other liquid which is pumped into the inlet of the eductor body 10 and through a replaceable multiport nozzle 14 made in this embodiment from polyoxymethylene (commonly referred to as POM and also known as polyacetal or polyformaldehyde or acetal plastic). POM is an engineering machinable thermoplastic used in precision parts that require high stiffness, low friction and excellent dimensional stability. It is commonly known under DuPont's trade name Delrin. The replaceable venturi-diffuser body is also made of POM which resists wear from the slurry mixtures pushed through the diffuser throat. Again as with the body, alternative materials for both the replaceable multiport jetting nozzle and the replaceable venturi-diffuser body can be readily substituted without departing from the spirit or scope of this disclosure. For example, another material such as a high-temperature high tensile strength ceramic material made of alumina could be substituted for POM if the mixing of high temperature materials was required. Other nonresilient materials could be substituted for the POM in the fabrication of both the multiport jetting nozzle and the venturi-diffuser, but would require the use of a gasket between the flange and the piping flange to properly seal the eductor body. Other materials well known to those skilled in the materials arts could be substituted without departing from the invention disclosed herein. As may be readily seen in FIG. 2 and FIG. 6, the replaceable nozzle provides outlet ports directed at an acute angle $\alpha$, as more clearly shown in FIG. 6, to the perpendicular face 17 of the nozzle body 14. In the cross-sectional view of FIG. 6, port 172 is formed with the angle $\alpha$ specifically to converge with the other ports' output at a point in the throat of the venturi-diffuser 18 as more easily shown in FIG. 10. As can also be seen on FIG. 6, body 14 provides a flange face 15 larger than the inner diameter of the eductor body, which is compressed as shown in FIG. 5 between the flange 23 and the connecting flange of the inlet piping 20 to seal the joint. In this embodiment, as shown in FIG. 7, three ports (171, 172 and 173) are provided in face 17, each directed at an angle to converge at a point 181 inside the throat of the venturi-diffuser 182 as shown in cross-section FIG. 10.

Figure 9:
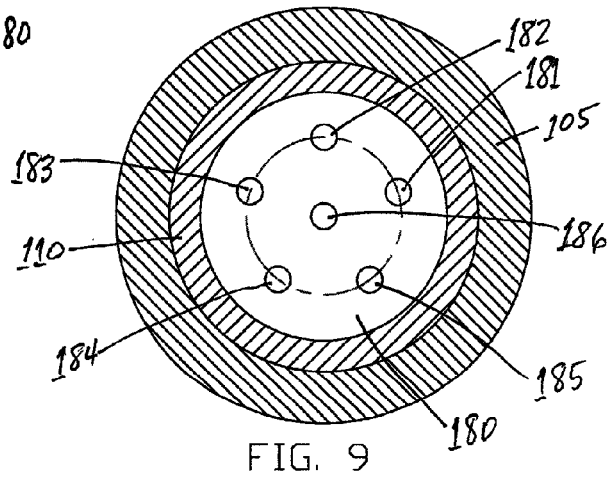
FIG. 9 is an outlet face view of the larger embodiment of the nozzle of FIG. 8.
Figure 11:
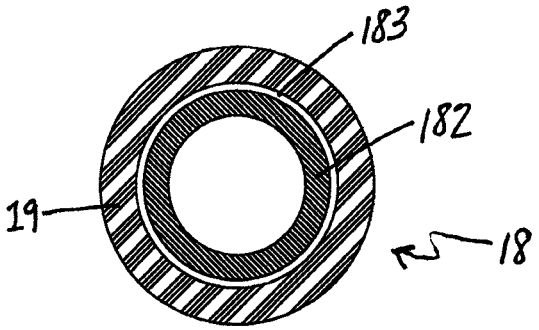
FIG. 11 is an inlet face view of the venturi-diffuser of FIG. 10.

Made from POM, this body 18, as shown in FIG. 5, provides a lip 183, throat 182 and widened diffuser end 21 for directing the turbulent motive flow 22 as shown in FIGS. 4 and 5 to the outlet 40 of FIGS. 4 and 5. The output from plurality of jetting nozzles (irrespective of the number of ports provided in the nozzle body such as shown in FIG. 7 or 9) converge at a point 181 central in the throat 182 of the smaller venturi-diffuser 18 in FIG. 10 and at a point 204 in the throat 206 of the larger diameter venturi-diffuser 200 of FIG. 12. FIG. 11 is an inlet face view of the venturi-diffuser of FIG. 10. Body 18 provides a throat 182 and lip 183 into which the motive flow and bulk material mixture is directed and ends with a flange face 19 which seats against the exterior outlet flange 43 of FIGS. 4 and 5 providing a hermetic seal of this venturi-diffuser body 18 in the eductor body 10.

Figure 8:
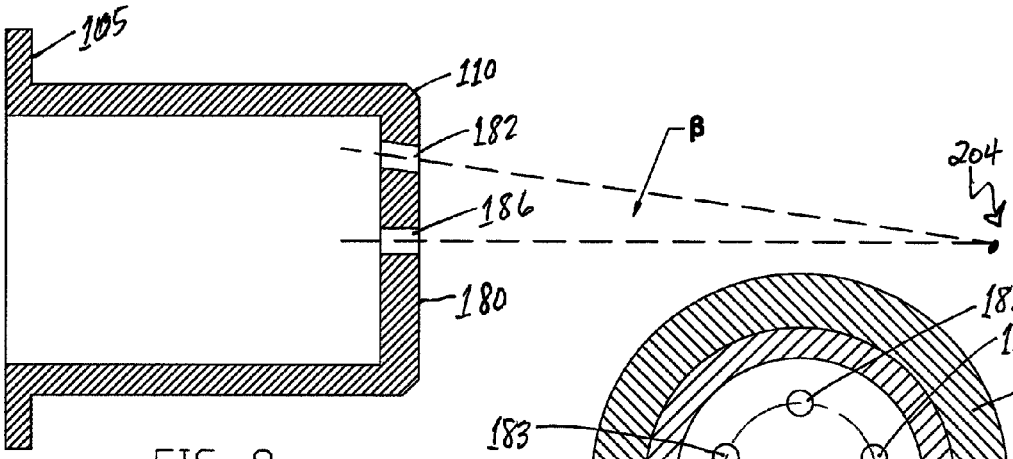
FIG. 8 is a cross-sectional view of a larger embodiment of the directed nozzle of the present invention providing six outlet ports.

Similarly, FIGS. 8 and 9 disclose an alternative jetting nozzle providing six outlet ports. Typically, the smaller inner diameter or ID eductor body will be limited by the number of outlet ports, so FIGS. 6 and 7 can be a four-inch ID design and FIGS. 8 and 9 can be a six-inch ID design, by way of example only and without limitation herein. As previously noted in FIG. 6, flange face 15 is intended to seat against the flange 23 on the eductor body 10 of FIGS. 4 and 5. This jetting nozzle is inserted in the inlet ID of the body and is provided with beveled edge 13 around the nozzle face 17 of FIG. 6. The angle is chosen to permit the outlets to converge at a point inside the throat of the venturi-diffuser 18, identified in FIGS. 6 and 10 at point 181.

Similarly, a larger diameter and replaceable alternative jetting nozzle is shown in FIGS. 8 and 9. This nozzle body provides a flange face 105 and leading beveled edge 110 and is ported with six ports 181-186 on face 180. As might be understood, the angle of the peripheral ports 181-185 are made at an angle β converging on a point inside the throat of the venturi-diffuser body. The central port 186 is not angled, but is concentric with the central longitudinal axis of the nozzle body.

Figure 12:
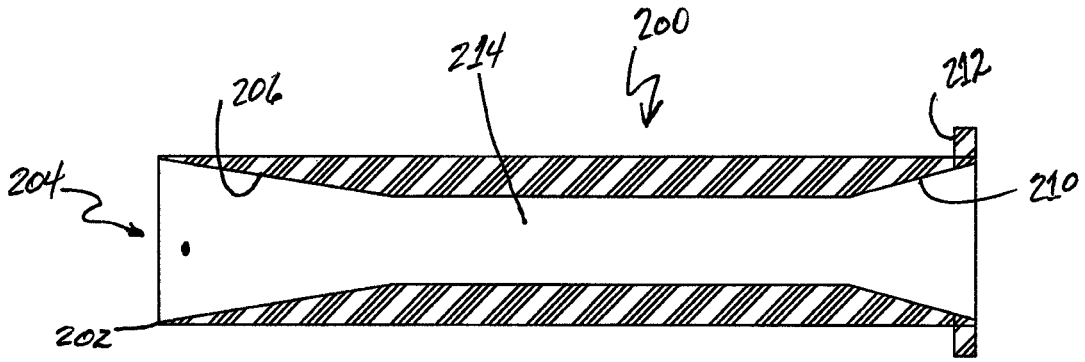
FIG. 12 is a cross-sectional side view of a larger embodiment of the venturi-diffuser.
Figure 13:
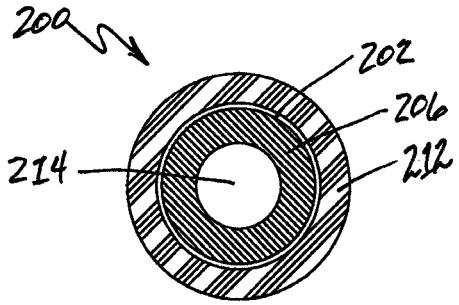
FIG. 13 is an inlet face view of the venturi-diffuser of FIG. 12.

Finally, as shown in FIGS. 12 and 13, the larger bodied replaceable venturi-diffuser 200 is used in a large ID eductor body providing an enlarged throat 206 inside a leading edge lip 202. The venturi throat 214 then flares into diffuser portion 210 returning the flow 44 to about 70% of the inlet pressure. Again, this venturi-diffuser body 200 provides a flange face 212 that secures the body 200 and hermetically seals the venturi-diffuser outlet path to the outlet side of the eductor. The focal point of the jetted nozzle flows is directed to a point 204 just inside the leading edge lip 202 of the nozzle in a manner similar to that found and described in the smaller diameter venturi-diffuser body of FIGS. 10 and 11.

This invention has been shown and described with respect to several preferred embodiments, but will be understood by one having ordinary skill in the art to which this invention pertains that various changes in the form and detail from the specific embodiments shown can be made without departing from the spirit and scope of the claimed invention.

The invention claimed is:

1. An eductor comprising:

a cylindrical body having a longitudinal bore therethrough and a perpendicular extension having a bore therethrough intersecting the cylindrical body permitting a flow of bulk materials into a low-pressure vestibular mixing chamber portion of the eductor;

said low-pressure vestibular mixing chamber portion of the eductor formed between an outlet face of a multiport jetting nozzle inserted in a first end of the cylindrical body, the intersection of the perpendicular extension, and an inlet lip of a venturi-diffuser inserted in a second end of the cylindrical body; and, said multiport jetting nozzle providing a plurality of ports for directing a fluid flow from a first inlet of the cylindrical body toward the inlet lip of the venturi-diffuser having a venturi-diffuser throat narrowing to provide turbulent flow and enlarging at an outlet of the venturi-diffuser;

wherein the fluid flow traversing the vestibular mixing chamber portion from the multiport jetting nozzle carries and mixes with the bulk material from the perpendicular extension; and the plurality of ports are angled for converging the fluid flow at a point within the venturi-diffuser.

2. The eductor of claim 1 wherein the plurality of ports comprises three or more directed ports angled for converging the fluid flow at the point within the venturi-diffuser.

3. The eductor of claim 1 wherein the plurality of ports comprises at least five directed ports angled for converging the fluid flow at the point within the venturi-diffuser.

4. A method of fluid mixing comprising:

supplying a fluidal bulk material to a perpendicular inlet of an eductor; and, supplying a fluid motive flow through an inlet of the eductor to a multiported jetting nozzle having a plurality of ports angled for directing the fluid motive flow across a vestibular section of the eductor and into a centralized portion of a venturi-diffuser for movement down the venturi-diffuser for homogeneously mixing the fluidal bulk material with the fluid motive flow;

wherein the vestibular section of the eductor is formed between an outlet face of the multiported jetting nozzle, an intersection of the perpendicular inlet with a body of the eductor, and an inlet of the venturi-diffuser; and at least a portion of homogenously mixing the fluidal bulk material with the fluid motive flow is within the vestibular section of the eductor.

5. The method of claim 4 wherein the fluidal bulk material comprises a slurry.

6. A method of fluid mixing of a variety of fluidal bulk materials with varying physical characteristics comprising:

supplying a first fluidal bulk material to a perpendicular inlet of an eductor;

supplying a motive fluid flow through an inlet of the eductor to a multiported nozzle directing the motive fluid flow across a vestibular section of the eductor, the multiported nozzle having a plurality of ports angled for converging the motive fluid flow in a centralized portion of a venturi-diffuser for movement down the venturi-diffuser for homogeneously mixing the fluidal bulk material with the motive fluid flow until the fluidal bulk material has been completely mixed;

adding a second fluidal bulk material to a secondary inlet on the perpendicular inlet of an eductor; and, varying a rate of passage of the second fluidal bulk material to the vestibular section of the eductor for mixing;

wherein the vestibular section of the eductor is formed between an outlet face of the multiported jetting nozzle, an intersection of the perpendicular inlet with a body of the eductor, and an inlet of the venturi-diffuser; and at least a portion of homogenously mixing the fluidal bulk material with the motive fluid flow is within the vestibular section of the eductor.

7. The method of claim 6 further comprising the additional step of varying the motive fluid flow to the multiported nozzle to correspond to physical characteristics of the second fluidal bulk material.

8. The method of claim 6 wherein the first fluidal bulk material comprises a slurry.

9. The method of claim 6 wherein the second fluidal bulk material comprises a slurry.

* * * * *